US009440249B1

(12) United States Patent
Kane et al.

(10) Patent No.: US 9,440,249 B1
(45) Date of Patent: Sep. 13, 2016

(54) APPLICATOR WANDS FOR CLEANING HVAC COILS

(71) Applicants: Timothy Kane, Greenwich, CT (US); George M Cruz, Norwalk, CT (US); Joseph J Franzino, Redding, CT (US)

(72) Inventors: Timothy Kane, Greenwich, CT (US); George M Cruz, Norwalk, CT (US); Joseph J Franzino, Redding, CT (US)

(73) Assignee: Crossford International, LLC, Stamford, CT (US)

( * ) Notice: Subject to any disclaimer, the term of this patent is extended or adjusted under 35 U.S.C. 154(b) by 240 days.

(21) Appl. No.: 13/986,421

(22) Filed: Apr. 30, 2013

(51) Int. Cl.
*B05B 7/12* (2006.01)
*B05B 15/06* (2006.01)

(52) U.S. Cl.
CPC ..... *B05B 15/067* (2013.01)

(58) Field of Classification Search
CPC ... B05B 7/12; B05B 9/0861; B05B 11/0059; B05B 9/01; B05B 1/18; B05B 1/3013
USPC ..... 239/302, 310, 337, 375, 378, 525, 526, 239/531, 532
See application file for complete search history.

(56) References Cited

U.S. PATENT DOCUMENTS

| | | | | |
|---|---|---|---|---|
| 3,727,841 | A * | 4/1973 | Hengesbach | 239/145 |
| 5,573,187 | A * | 11/1996 | Proctor | 239/532 |
| 5,992,690 | A * | 11/1999 | Tracy | 222/79 |
| 6,595,437 | B1 * | 7/2003 | Lawson et al. | 239/119 |
| 6,896,203 | B1 * | 5/2005 | Restive | 239/302 |
| D624,718 | S * | 9/2010 | Kane | D32/35 |
| 2005/0179258 | A1 * | 8/2005 | Brandt et al. | 285/308 |

* cited by examiner

*Primary Examiner* — Justin Jonaitis
(74) *Attorney, Agent, or Firm* — Carson C. K. Fincham; Fincham Downs, LLC

(57) ABSTRACT

Applicator wands for cleaning coils and fins of outdoor condenser units and the like with water and cleaning chemical, and a connector link for assembly of wand with siphon container.

8 Claims, 9 Drawing Sheets

APPLICATOR WANDS FOR CLEANING HVAC COILS

PRIORITY

This Application is a continuation-in-part of U.S. application Ser. No. 12/283,083 filed Sep. 9, 2008 which is incorporated by reference herein in its entirety.

BACKGROUND OF THE INVENTION

The present invention is directed to applicator wands for cleaning finned coils in HVAC installations including particularly the coils located in outdoor, rooftop and attic HVAC units and coils located where electricity is usually not available.

A typical HVAC installation for residential and commercial buildings includes an outdoor condenser unit having heat exchange coils, indoor evaporator units having heat exchange fin and coil combinations with water condensate collection trays and drain lines located in ductwork, and air handling components.

Outdoor condenser coils are arranged in banks at the outer periphery of a condenser unit and are cooled with ambient air drawn through the coils by an electric fan. In operation, the coils accumulate deposits of pollen, grass clippings, insects, and so forth carried by ambient air drawn through the coils. In addition, the outdoor condenser coils develop an oxidized film or coating that diminishes heat exchange efficiency and requires periodic removal by chemical cleaning of the coil surface.

For optimum operating efficiency of HVAC installations, heat transfer coils must be cleaned from time to time of such deposits and coatings that build-up in normal operation and by natural processes (i.e., oxidation) with passage of time. The present invention provides an apparatus and method especially suited for cleaning outdoor coils in an effective manner so as to remove accumulated deposits and coil films or coatings which are detrimental to HVAC operating efficiency. The invention may be used for a routine maintenance schedule that checks building operating costs by ensuring thermal efficiency and extending the useful operating life of HVAC installations.

Copending U.S. application Ser. No. 12/283,083 filed Sep. 9, 2008 provides an apparatus containing all components and consumable cleaners including water and chemical for cleaning HVAC coils situated in tough to reach areas, and further provides a method for effectively cleaning such coils as well as applicator wands for spraying cleaners onto the coils. This application is directed to applicator wands disclosed in that application and added in this C-I-P application.

SUMMARY OF THE INVENTION

In accordance with the both preferred and modified apparatus and method of the invention described in the copending application, an applicator wand enables an inside-to-outside cleaning of HVAC coil banks against the outside-to-inside direction of airflow through unit coils in normal operation. In a typical rooftop HVAC condenser coil unit, heat transfer coils are mounted vertically in framework along the outer sides of the unit. A cooling fan is situated horizontally in the topside of the unit. The fan draws ambient air more or less horizontally through the vertical heat transfer coils and directs exhaust airflow upwardly from the unit. Airflow through the unit is exterior-to-interior-to-exterior. Applicants have observed that such cooling air flow draws debris (grass clippings, insects, etc) from exterior sources to lodge lightly at the exterior side of coils and fins so as to impede air flow and to reduce coil heat transfer efficiency by reducing effective surface area of the coils. If not removed debris over time degrades to a pumice that promotes rusting of metal components especially framework of condenser units.

Grille work in the top side of the unit allows for access to the interior surface of the coils by means of an applicator wand so that the entire coil surface is cleaned by directing cleaning solution through the coils and fins from interior-to-exterior of the HVAC unit. The result is a thorough cleaning of the coils and the HVAC units by driving debris out of the delicate coils fins without harming them. Use of an applicator wand in this way obviates the need for dismantling a condenser unit for access to coil interior surface.

A preferred embodiment of applicator wand comprises an elongate hollow rod fitted at its distal end with a nozzle for directing cleaning solution in an interior-to-exterior direction through the entire area of unit coils for dislodging debris accumulated in the coils.

Another preferred embodiment of applicator wand comprises an elongate hollow rod fitted at its distal end with a nozzle for directing cleaning solution, a section of flexible tubing connected at one end to the proximal end of the hollow rod and at its other end to connector link. For its part, the connector link forms part of a fluid passage and is inserted into the outlet of a siphon bottle containing cleaning fluid while a hand held nozzle supplies pressurized tap water to the siphon bottle inlet, and through the link to the wand distal nozzle. The connector link has a retaining arm securing the link to the siphon bottle whereby the link remains in place withstanding such hydraulic pressure as is developed in using the applicator wand.

Specific examples are included in the following description for purposes of clarity, but various details can be changed within the scope of the present invention.

OBJECTS OF THE INVENTION

An object of the invention is to provide applicator wands for cleaning HVAC condenser coils.

Another object of the invention is to provide a connector link for applicator wands.

Other and further objects of the invention will become apparent with an understanding of the following detailed description of the invention or upon employment of the invention in practice.

BRIEF DESCRIPTION OF THE DRAWING

A preferred embodiment of the invention has been chosen for detailed description to enable those having ordinary skill in the art to which the invention pertains to readily understand how to construct and use the invention and is shown in the accompanying drawing in which.

DETAILED DESCRIPTION OF PREFERRED EMBODIMENT

Figure 1A:
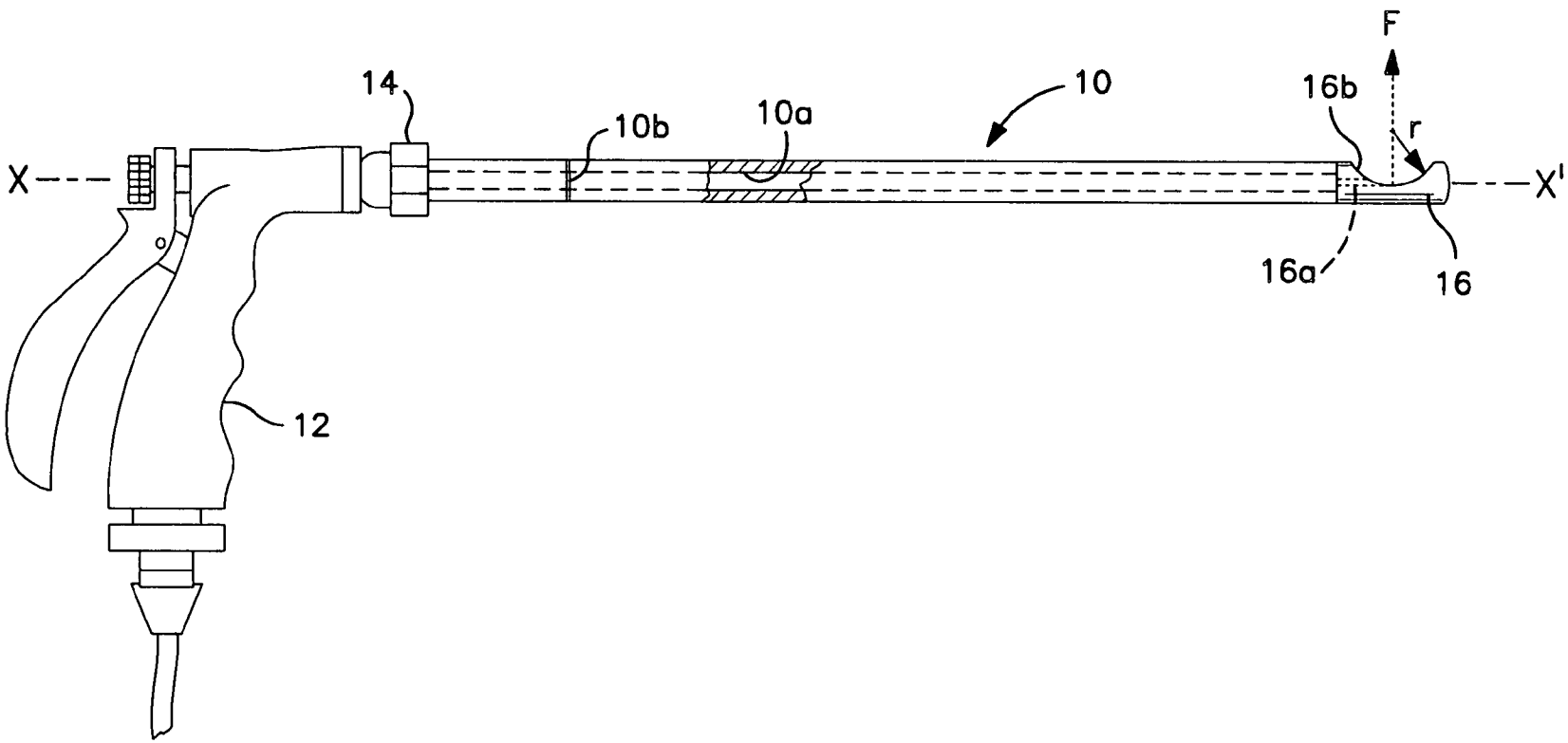
FIGS. 1*a-b* are side views of preferred and modified embodiments of spray nozzle and applicator wands according to the invention.

Referring to the drawing, a preferred embodiment of the invention comprises applicator wand 10 (FIG. 1*a*) as an elongate rigid supply pipe or tube preferably stainless steel rotatably fitted at one end to pistol grip nozzle 12 with a quick connect fitting 14, and having an approximately 90° spray nozzle 16 at its other end. Spray nozzle 10*b* is preferably a brass cylindrical body with an orifice 16*a* of smaller diameter than bore diameter 10*a* of its supply pipe for the purpose determining system flow at approximately 0.5 gpm. Minimum orifice size is 04. The cylindrical spray nozzle is recessed by arced wall 16*b* cut into the brass body to redirect flow F from the wand nozzle at 90° from axis x-x' of the wand. Arced wall 10*e* is a cylindrical wall having a radius r of approximately ⅝$^{ths}$ inch with radius r lying in a common plane with axis x-x' and with the radius being tangent to the x-x' axis. It is to be understood that the wand is rotatable at fitting 14 about axis x-x' with respect to spray handle 12 for issuing cleaning solution in any direction 360° normal to wand axis for cleaning condenser coils.

Figure 1B:
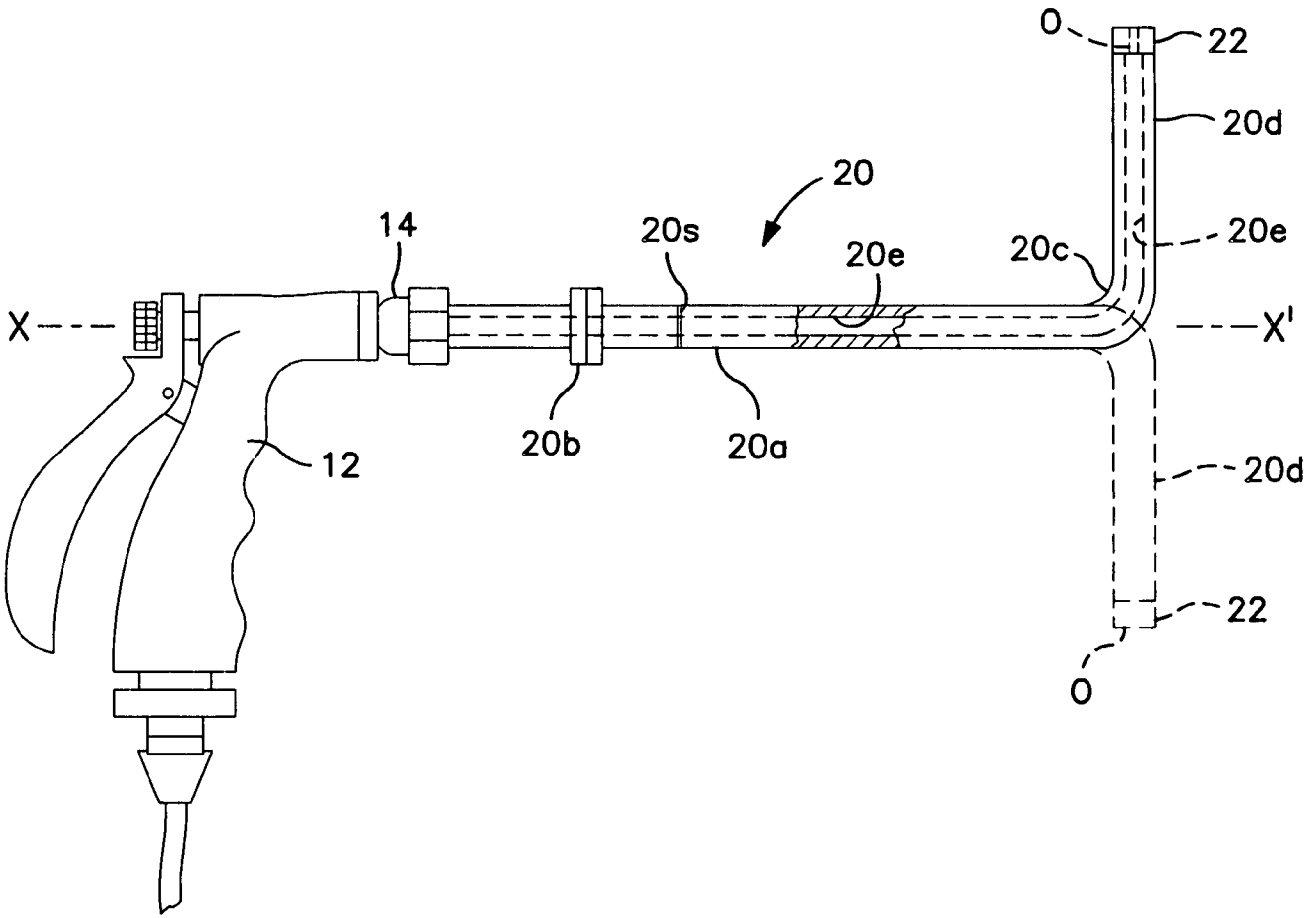
Figure 2:
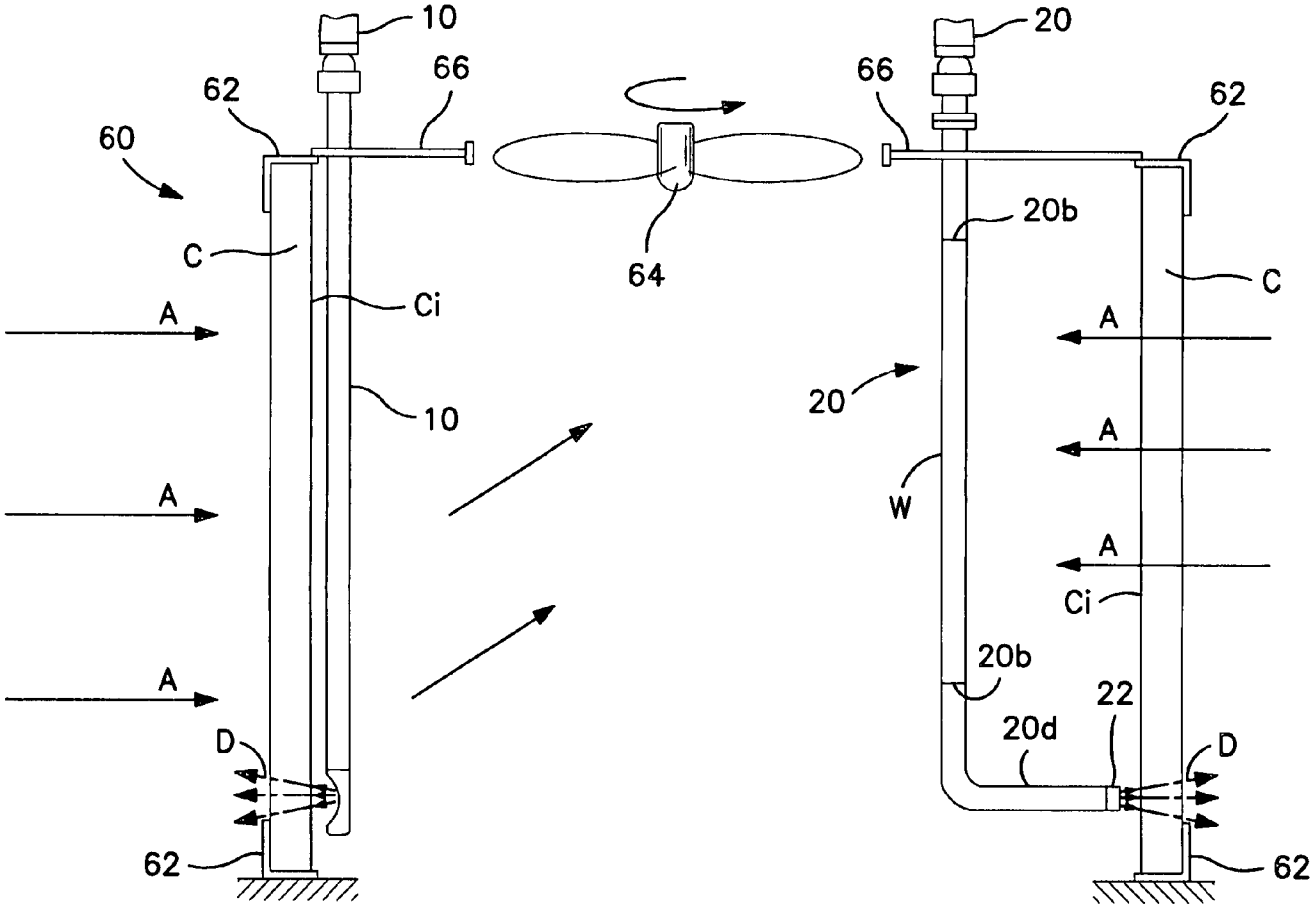
FIG. 2 is a schematic illustration of an outdoor condenser coil being cleaned using an applicator wand according to the invention.

Applicator wand 20 (FIG. 1*b*) is an angled rigid supply pipe or tube 20*a* preferably stainless steel fitted at one end to pistol grip nozzle 12 with a quick connect fitting 14, having a swivel joint 20*b*, and having an approximately 90° bend 20*c* of the tube to define wand stub 20*d* fitted with spray nozzle 22 at its other end. Spray nozzle is preferably a brass cylindrical body with orifice O of smaller diameter than bore diameter 20*e* of its supply pipe for the purpose determining system flow at approximately 0.5 gpm. Minimum orifice size is 04. It is to be understood that the wand is rotatable at the swivel joint 20*b* with respect to spray handle 12 for issuing cleaning solution from nozzle 22 in any direction 360° normal to wand axis x-x' for cleaning condenser coils. The bend of the tube allows reach of end nozzle 22 to the surface of coils where the surface is laterally spaced from point of entry of wand into condenser unit as shown in FIG. 2.

Figure 1D:
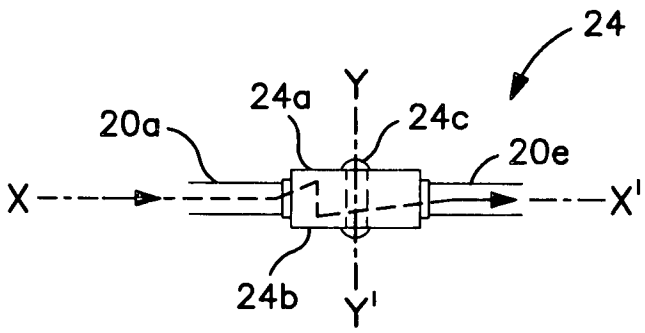
FIGS. 1*c-d* are side elevation and plan view respectively of pivotal joints for applicator wands.
Figure 1C:
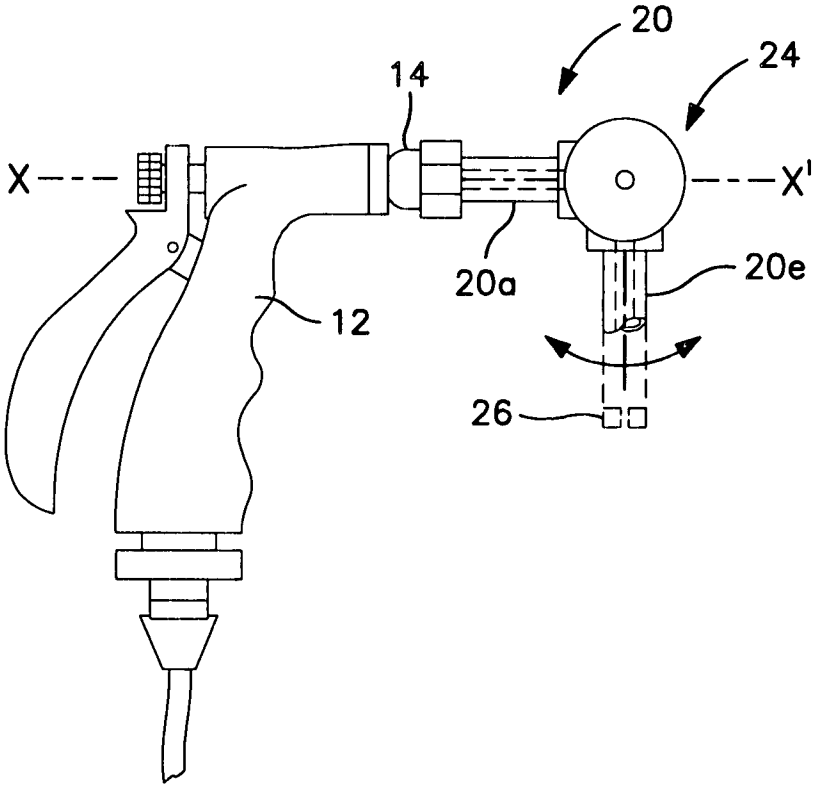

FIGS. 1*c-d* illustrate a pivoting joint 24 fitted to supply pipe 20*a* for rotating an applicator wand about y-y' axis normal to x-x' axis. Where pistol grip nozzle 12 is oriented vertically, pivot joint 24 permits movement of wand nozzle in a vertical plane about y-y' axis. As shown in FIG. 1*d*, the pivot joint 24 comprises stator 24*a* and rotor 24*b* shells held together by pivot pin 24*c* for rotor movement on y-y' axis. The stator is stationary with respect to pistol grip through pipe segment 20*a* so that the rotor move pipe segment 20*e* and nozzle 26 as indicated. Internal passages indicated by dash line accommodate fluid flow through the pivot joint. It is to be understood that both swivel and pivot joints maybe used together on a particular applicator wand for universal direction of spray from wand nozzle. Ordinarily, either a swivel joint or a pivot joint is used for applicator wands.

Figure 3:
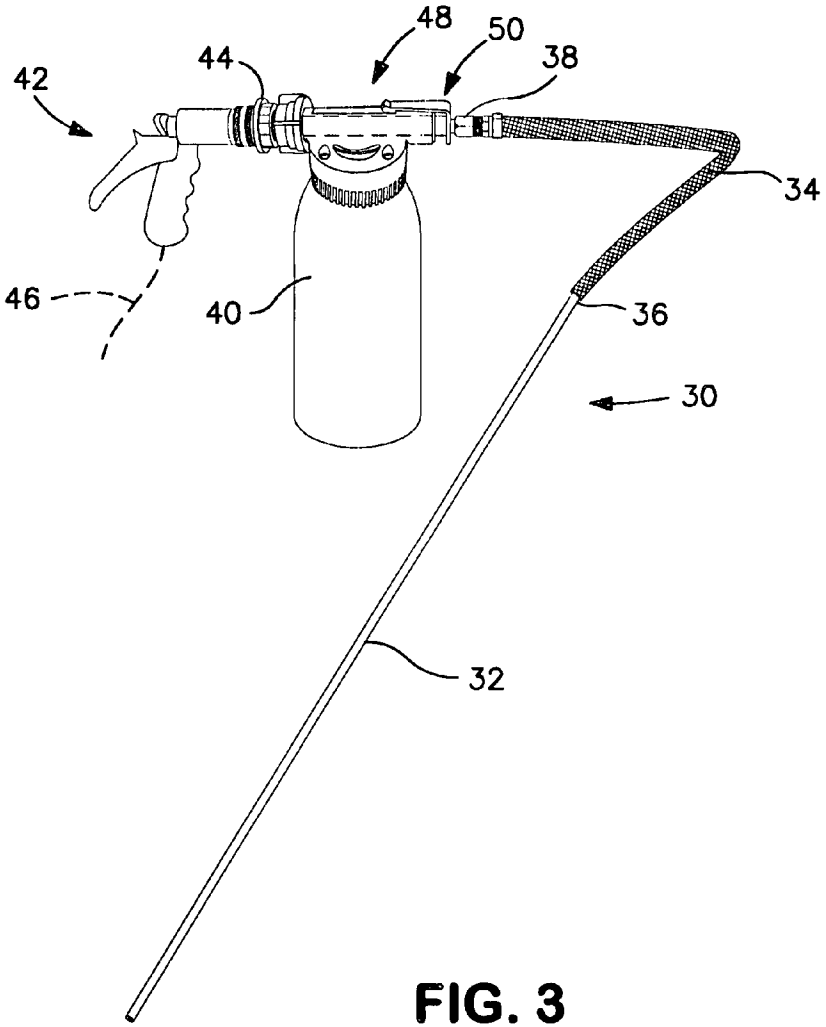
FIG. 3 is a perspective view of another preferred embodiment of applicator wand and connector link according to the invention assembled with siphon container for cleaning fluid and with hand-held water supply nozzle.
Figure 4:
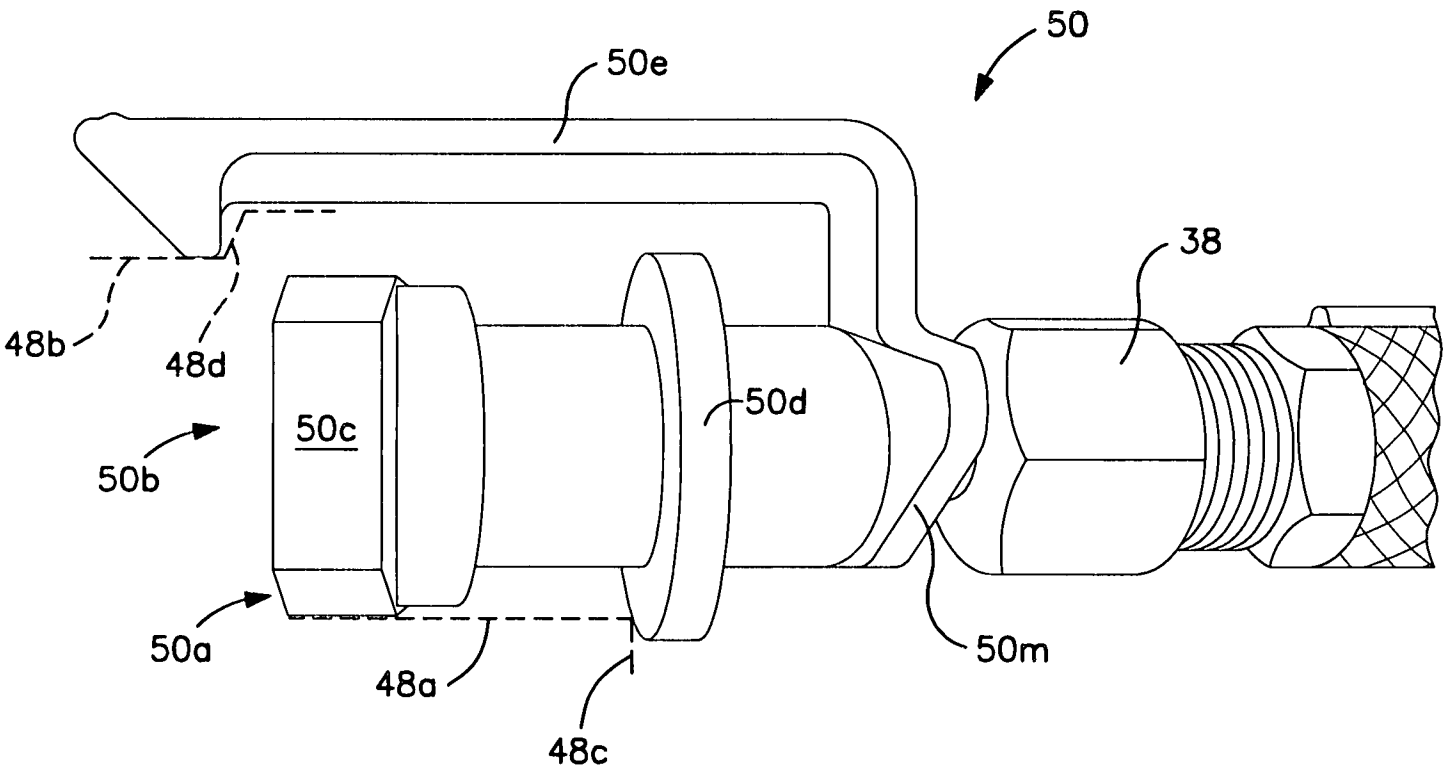
FIG. 4 is an elevation view of connector link of FIG. 3 in assembly with applicator wand.
Figure 5:
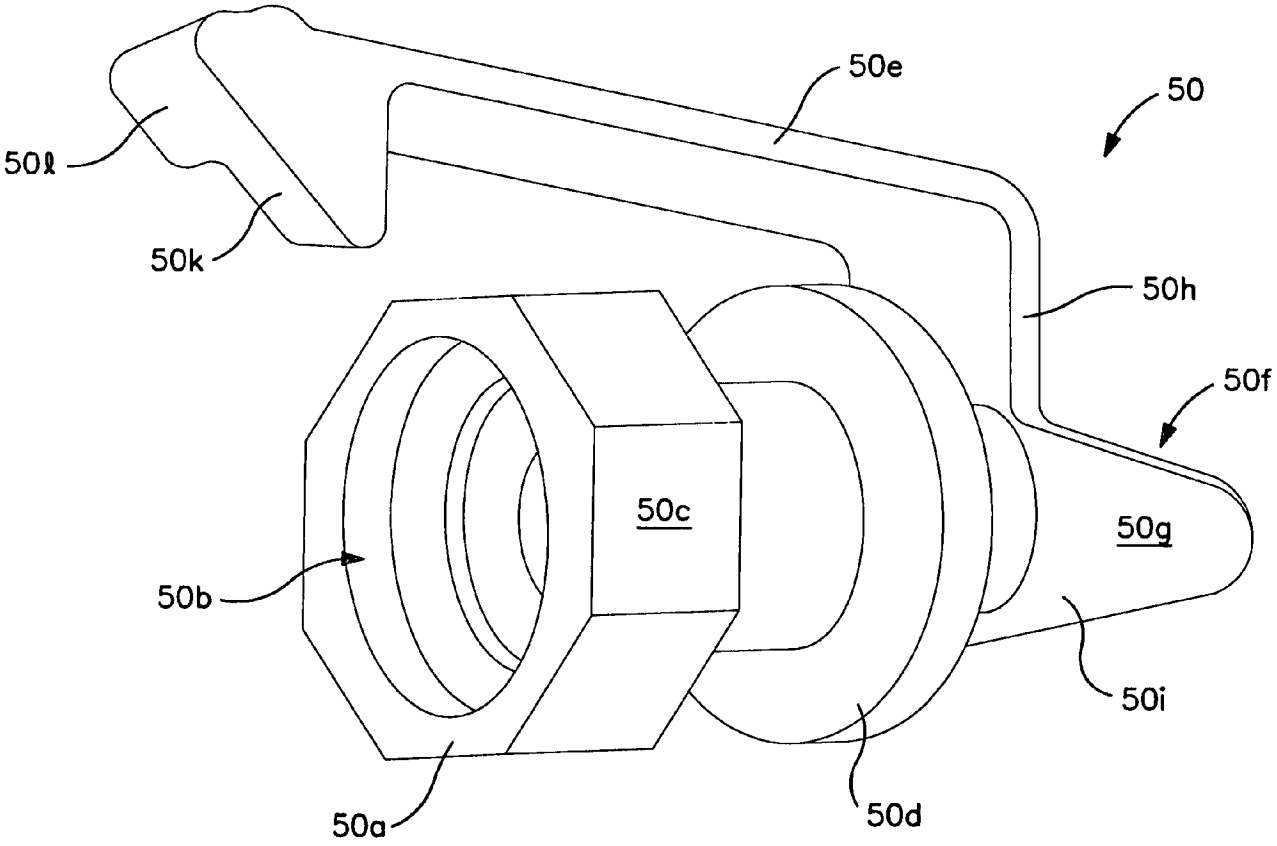
FIG. 5 is a perspective view of connector link of FIG. 3.

Applicator extension wands W shown in FIGS. 1 and 3 of application Ser. No. 12/283,083 may be provided in several lengths for versatility of the invention in cleaning condenser coils. If desired, the applicator wands of FIGS. 1*a-b* may include socket joint 10*b* and 20*s* in its supply tube to accommodate extension wands W having mating socket ends for extending wand length as needed for cleaning coils of particular condenser units.

Another preferred embodiment of applicator wand 30 is shown in FIG. 3 comprising an elongate rigid supply pipe or tube 32 preferably stainless steel secured to one end of a length of flexible tubing 34 by a suitable watertight fitting 36. The other end of the flexible tubing has a brass receptor 38 with internal bore providing a fluid passageway into the flexible hose 34 and tube 32. The tube 32, flexible tubing 34, and brass receptor may be referred to as applicator wand assembly.

The wand according to the invention applies cleaning fluid from a siphon container 40 actuated by a pistol grip nozzle 42 with a quick connect fitting 44 for attachment to the container. The pistol grip nozzle is a manually activated valve having an outlet port of given size to regulate flow of pressurized fluid such as water. The pistol grip nozzle receives pressurized water through a supply hose 46, directs the water through a siphon head 48 secured to the cleaning fluid container. Siphon head has an interior passage 48*a* of lesser size than size of pistol grip valve outlet port to develop under-pressure in passage 48*a*. A duct 48*d* extends from interior passage to container 40 for drawing cleaning fluid into the passage.

The siphon head fluid passage delivers a solution of water and cleaning fluid into the applicator wand by means of connector link 50. The connector link facilitates quick assembly of applicator wand to the siphon head.

Connector link 50 comprises a main body 50*a* of generally cylindrical configuration with interior passage 50*b* for cleaning solution, a conical end 50*g* for insertion into brass receptor 38, a fluid tight sealing surface 50*c* for engaging and sealing the interior surface of the siphon head fluid passage 48*a*, an abutment plate or collar 50*d* for limiting the extent of insertion of link into the siphon head passage, and a retaining arm 50*e* cooperating with recess 48*b* in the siphon head for retaining assembly of applicator wand and cleaning fluid container to withstand hydraulic pressure developed within container and wand during a coil cleaning operation.

Figure 6:
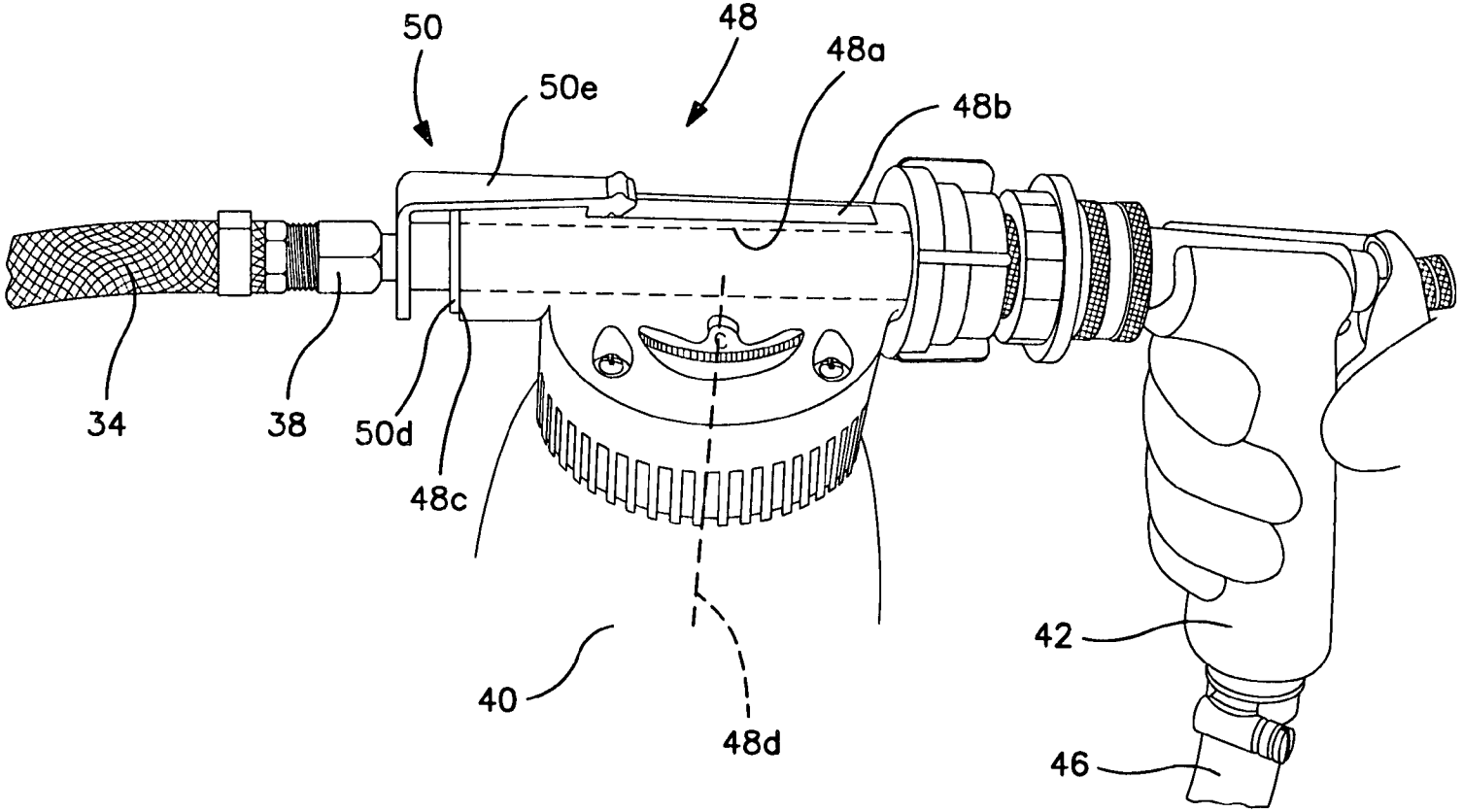
FIG. 6 is a schematic view of coil cleaning assembly of hand held spray nozzle, siphon container for cleaning fluid, connector link inserted into container cover fluid passageway, and applicator wand.

The connector link is preferably of unitary plastic body of generally cylindrical construction with open ended interior passageway for cleaning fluid to pass from siphon container to applicator wand. Cylindrical sealing surface 50*c* has an outer diameter and axial length adequate to engage and seal interior surface of siphon head passage 48*b* while admitting cleaning fluid for passage through the link body. Cylindrical collar or plate 50*d* spaced from seal surface 50*c* engages exterior rim 48*c* (FIGS. 6-7) of siphon passage for limiting extent of insertion of link into siphon head. Conical end 50*f* of the link presents a tapered receptor surface 50*g* for insertion into applicator receptor so as to allow use of several possible size brass fittings that can accommodate the link. The connector body may be provided with lateral wings 50*m* adjacent conical as an aid in pushing the link into the siphon passage.

Figure 7:
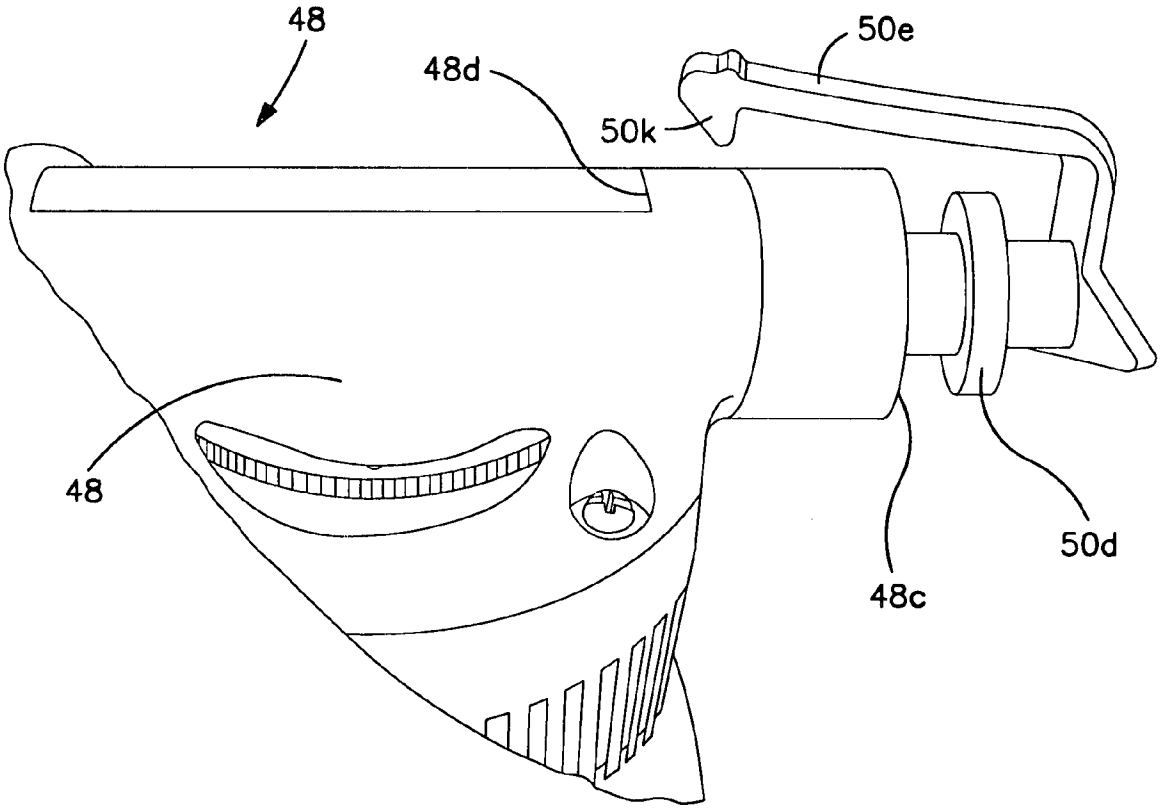
FIG. 7 is a schematic view of connector link being inserted into container cover fluid passageway.

Retaining arm 50*e* forms an integral part of link 50 and comprises mounting leg 50 located intermediate cone base 50*i* and collar 50*d* for securing arm to the link body. The mounting leg has a length sufficient to clear the top surface of the siphon fluid passage which can pass between body and arm. The arm projects at a right angle from the leg and extends approximately parallel to link body terminating in a lobe or finger 50*h* approximately normal to the arm while leaving a terminal portion of the arm to serve as a spring tab 50*l* for spring action of the arm. The arm is able to flex or spring with respect to link body, and cooperates with groove or recess 48*b* in the siphon head. The spring arm snaps into the groove so as to retain wand and siphon container in assembled position during cleaning operations using pressurized fluid. The lobe extends into the groove engaging groove end wall 48*d* to hold link and head together. Movement of the link with respect to siphon head groove is shown in FIG. 7 where arm is lifted manually for disengaging lobe from groove and removing link from siphon head.

FIG. 2 illustrates schematically an internal arrangement of components of a HVAC condenser unit 60 including coil and fin banks C mounted vertically by unit frame 62 around the periphery of the condenser unit, and a horizontally oriented motor driven fan 64 for drawing ambient air A through coil banks C to cool refrigerant flowing through the coils. A grille 66 comprising an open bar structure secures the fan in place over the condenser unit so that the entire inside surface $C_i$ of each bank of coils is accessible to applicator wands 10 and 20 passed through grille openings for applying cleaning solution through the coils in an interior-to-exterior direction D against flow of incoming cooling air represented by arrow A. It is to be appreciated that inflowing air A over time draws debris such as insects and grass clippings into the coil and fin banks so as to diminish thermal efficiency of the coils. Applicants have observed that cleaning solutions applied in the same direction of air flow tend to drive lightly lodged debris further into coil and fin banks thereby exacerbating loss of thermal efficiency, and complicating the job of properly cleaning the coils. Applicants have determined that by directing a cleaning solution of up to approximately 0.5 gpm at up to approximately 120 psi from the interior side of the coil is highly effective in dislodging debris lightly lodged at the exterior side of the coil and fin network. It is to be further understood, that by reason of the apparatus according to the invention including the applicator wand, it is not necessary to dismantle the condenser fan and supporting grille work for attaining access to the interior face $C_i$ of each coil bank in the condenser unit. The applicator wands enable a technician to reach the entire inner surface of each coil bank for application of cleaning solution. In the case of applicator wand 20, an extension wand W may be used along with stub 20*d* to attain proper vertical and horizontal reach of nozzle 22 near to interior face $C_i$ of coil bank C.

Various changes may be made to the structure embodying the principles of the invention. At several places in the specification values are indicated as being approximate, which is to be understood as covering a range of 20% plus to 20% minus the value indicated. The foregoing embodiments are set forth in an illustrative and not in a limiting sense. The scope of the invention is defined by the claims appended hereto.

What is claimed is:

1. A connector link between an applicator wand assembly and a cleaning fluid siphon container with siphon head that receives pressurized water to issue a cleaning solution through a siphon head passage, through the link, and into the wand assembly, the siphon head having a link retaining recess slot extending parallel to the siphon head passage, the connector link comprising a main body having an interior passage for flow of cleaning solution from the siphon passage to the wand assembly, the link being adapted for insertion into the siphon passage, the link having a sealing surface for engaging and sealing the siphon head passage, the link having a collar to limit insertion of link into siphon passage, the link having a receptor surface for connection to the wand assembly, the link having a retaining arm spaced from and extending along the main body toward the siphon head for engaging the link retaining recess slot for holding wand to siphon head for passage of pressurized cleaning solution.

2. The connector link of claim 1, wherein the main body of the connector link comprises a unitary plastic body.

3. The connector link of claim 1, wherein the retaining arm is constructed of a pliable material to permit the retaining arm to flex with respect to the main body.

4. A connector link in a path for fluid flow from a pressurized water supply hose through a siphon source of cleaning fluid to an applicator wand assembly, the connector link comprising a main body with interior passage for fluid flow, a first sealing surface for fluid tight engagement with the applicator wand assembly, a second sealing surface inserted into the siphon for fluid tight engagement with the siphon source, the link body having an abutment to limit insertion of link into siphon passage, the link having a retaining arm connected to the body between the first and second sealing surfaces, the retaining arm extending generally parallel to the main body and; comprising a finger for engagement with a retaining slot of the siphon source to hold the siphon source and applicator wand assembly together when pressurized fluid flows through the path, the retaining slot disposeds on the siphon source parallel to and in-line with the retaining arm.

5. The connector link of claim 4, wherein the main body of the connector link comprises a unitary plastic body.

6. The connector link of claim 4, wherein the retaining arm is constructed of a pliable material to permit the retaining arm to flex with respect to the main body.

7. An applicator wand for use in cleaning coils of a condenser unit of an HVAC installation with cleaning solution, the wand connected to a manually activated valve to regulate flow of pressurized fluid, the valve having an outlet port of given size for receiving a rotatable fluid tight connection, the outlet port connected to a siphon head having an interior passage of size less than given size of outlet port to create under-pressure within the interior passage, the siphon head having a recess parallel to the interior passage, the siphon head attached to a container of cleaning fluid, the siphon having a duct connecting interior passage and container to draw cleaning fluid into the passage, a flexible tube having a receptor at one end for receiving cleaning solution from the interior passage, a connector link for attaching the siphon interior passage to the receptor end of the flexible tube for flow of cleaning fluid, the connector link having a main body with an interior passage and a conical end for insertion into the receptor of the flexible tube, the link having a fluid tight sealing surface inserted into the siphon interior passage and there forming a fluid tight seal, the main body having an abutment to limit insertion of link into siphon passage, the connecting link further having a retaining spring arm secured to and extending approximately parallel to link body and terminating in a lobe engaging the siphon head recess to hold siphon and flexible tube together when pressurized fluid is flowing through siphon into flexible tube, a nozzle rod in the form of a rigid tube with an x-x' axis connected at one end to the other end of the flexible tube, the nozzle rod having an interior axial passage for cleaning fluid, the nozzle rod having at its other end an outlet nozzle effective to direct fluid flow from the wand at an angle approximately 90° to the x-x' axis.

8. The applicator wand of claim 7, wherein the manually activated valve comprises a pistol grip nozzle.

* * * * *